US006571676B1

(12) United States Patent
Folsom et al.

(10) Patent No.: US 6,571,676 B1
(45) Date of Patent: Jun. 3, 2003

(54) COMPACT ARTILLERY

(76) Inventors: Lawrence R. Folsom, 5 Valley View Blvd. #1222, Rensselear, NY (US) 12144; Martin Hughes, 4 Meadow Ridge Dr., Pittsfield, MA (US) 01201; Clive Tucker, 19 Caratina Ave., Pittsfield, MA (US) 01201; Steven L. Adams, 4901 Fillmore St., Hollywood, FL (US) 33021; Robert J. Kogut, P.O. Box 551, Waitsfield, VT (US) 05673; George R. Wilson, Jr., 704 Silver Linden Dr., La Platta, MD (US) 20648; Robert E. Thompson, 664 Currant Ct., La Platta, MD (US) 20646

( * ) Notice: Subject to any disclaimer, the term of this patent is extended or adjusted under 35 U.S.C. 154(b) by 0 days.

(21) Appl. No.: 10/006,319

(22) Filed: Dec. 4, 2001

Related U.S. Application Data

(60) Provisional application No. 60/251,349, filed on Dec. 4, 2000.

(51) Int. Cl.[7] ..... F41A 3/00; F41C 27/00

(52) U.S. Cl. ..... 89/17; 42/75.02

(58) Field of Search ..... 89/17, 19, 20.2, 89/1.704; 42/75.02

(56) References Cited

U.S. PATENT DOCUMENTS 1,234,575 A * 7/1917 Schneider ..... 89/14.05
1,393,057 A * 10/1921 Vollmer ..... 89/16
2,807,195 A * 9/1957 Musser ..... 89/1.704
2,922,338 A * 1/1960 Barbe ..... 89/1.3
3,755,948 A * 9/1973 Heinicke ..... 42/17
3,877,167 A * 4/1975 Keppeler ..... 42/75.02
4,690,032 A * 9/1987 Stoner ..... 89/43.01
5,837,920 A * 11/1998 Staiert et al. ..... 89/7

* cited by examiner

*Primary Examiner*—Charles T. Jordan
*Assistant Examiner*—M. Thomson
(74) *Attorney, Agent, or Firm*—J. Michael Neary

(57) ABSTRACT

A gun system has a two piece cannon assembly that is separated between a removable chamber instead of a traditional breech, and a projectile forcing cone. The chamber has a plug at one end that can accommodate any type of ignition system, and the other end is open and is attached to the barrel with a connection fitting. High pressure gases created by combustion of the propellant are sealed with a high-pressure gas compression seal at the interface between the chamber and the barrel. The connection fitting provides an attachment for a rear cannon bearing slide, which rides on rails attached to the main support structure, and also reacts any torque induced into the barrel from the actuation of the chamber/barrel locking collar. A turntable upon which are mounted two chamber elevating/support mechanisms and two projectile loader/rammer mechanisms is positioned around one of the main support structure legs.

5 Claims, 11 Drawing Sheets

SIDE SECTION

SECTION THROUGH CHAMBER SEAL

RECOIL ENERGY RECOVERY SCHEMATIC

RECOIL / COUNTER RECOIL SCHEMATIC

COMPACT ARTILLERY

This relates to U.S. Provisional Application 60/251,349 filed on Dec. 4, 2000. This invention pertains to long range artillery, and more particularly to artillery having a low profile and improved performance.

BACKGROUND OF THE INVENTION

There is a resurgence of interest in the US Navy in long range artillery as a replacement for missiles due to the cost savings involved. That is, even though the missile launcher is normally cheaper than a gun of similar caliber, each missile is much more expensive than the projectile and propellant for the gun and this soon outweighs the extra cost of the gun system.

To obtain greater range, the gun barrels must be longer or the chamber pressure must be greater. A combination of these two factors, together with optimum projectile design, provides the best opportunity for long range firings. However, the protrusion of the barrel above the deck is vulnerable to detection by enemy radar, hence it is of interest to reduce this to a minimum.

To maximize the length of barrel for a given protrusion of the barrel from the housing module, there should be a minimum of recoiled components behind the chamber/breech, and also, the recoil stroke should be as short as possible. The optimum space utilization is to have only enough room behind the back of the cannon assembly for recoiling. For this to be effected, the chamber must be separated from the barrel to allow for loading of the projectile and charge. This also allows a reduction in time between shots as the charge may be loaded at the same time as the projectile.

The gun described herein embodies the necessary features to allow for compact stowage as well as providing improved performance. A 5 inch caliber smooth bore barrel has been assumed, however the design can be readily scaled up or down.

SUMMARY OF THE INVENTION

The invention provides a gun system that incorporates a two piece cannon assembly that is separated between the chamber and the projectile forcing cone. The gun described has no traditional breech. It has a removable chamber instead which has a plug at one end that can accommodate any type of ignition system that may be required. The other end is open and is attached to the barrel with a connection fitting that is clamped to the barrel by a threaded collar. The high pressure gases created by the propellant combustion are sealed with a high-pressure gas compression seal at the interface between the chamber and the barrel. The lower side of the connection fitting has a locking collar screwed into it. The internal diameter of this locking collar has a bayonet feature or interrupted thread to suit the top end of the chamber. A torque plate, which extends out beyond the edge of the connection fitting, is attached to the lower face of the collar. A slot in the torque plate aligns with the pin of a slide actuator that is attached to a frame cross-member. When the cannon assembly is in battery position, the actuator pin is located inside the torque plate slot.

The connection fitting also provides the attachment for the rear cannon bearing slide which rides on rails attached to the main support structure. This also reacts any torque induced into the barrel from the actuation of the chamber/barrel locking collar.

To provide adequate clearance to the loading mechanism, the recoil cylinders are mounted in front of (above) the chamber/barrel connection fitting. The lower end of the cylinders are attached to the connection fitting. The structure necessary to support the front of the recoil cylinders and hence transmit the recoil force to the main support, provides a suitable mounting for the front barrel slide. The resultant extended "wheelbase" between the front and rear slides ensures improved shot repeatability.

A turntable upon which are mounted two chamber elevating/support mechanisms and two projectile loader/rammer mechanisms is positioned around one of the main support structure legs.

DESCRIPTION OF THE DRAWINGS

The invention and its many attendant objects and advantages will become more clear upon reading the following description of the preferred embodiment in conjunction with a review of the following drawings, wherein.

DETAILED DESCRIPTION OF THE PREFERRED EMBODIMENT

Figure 1:
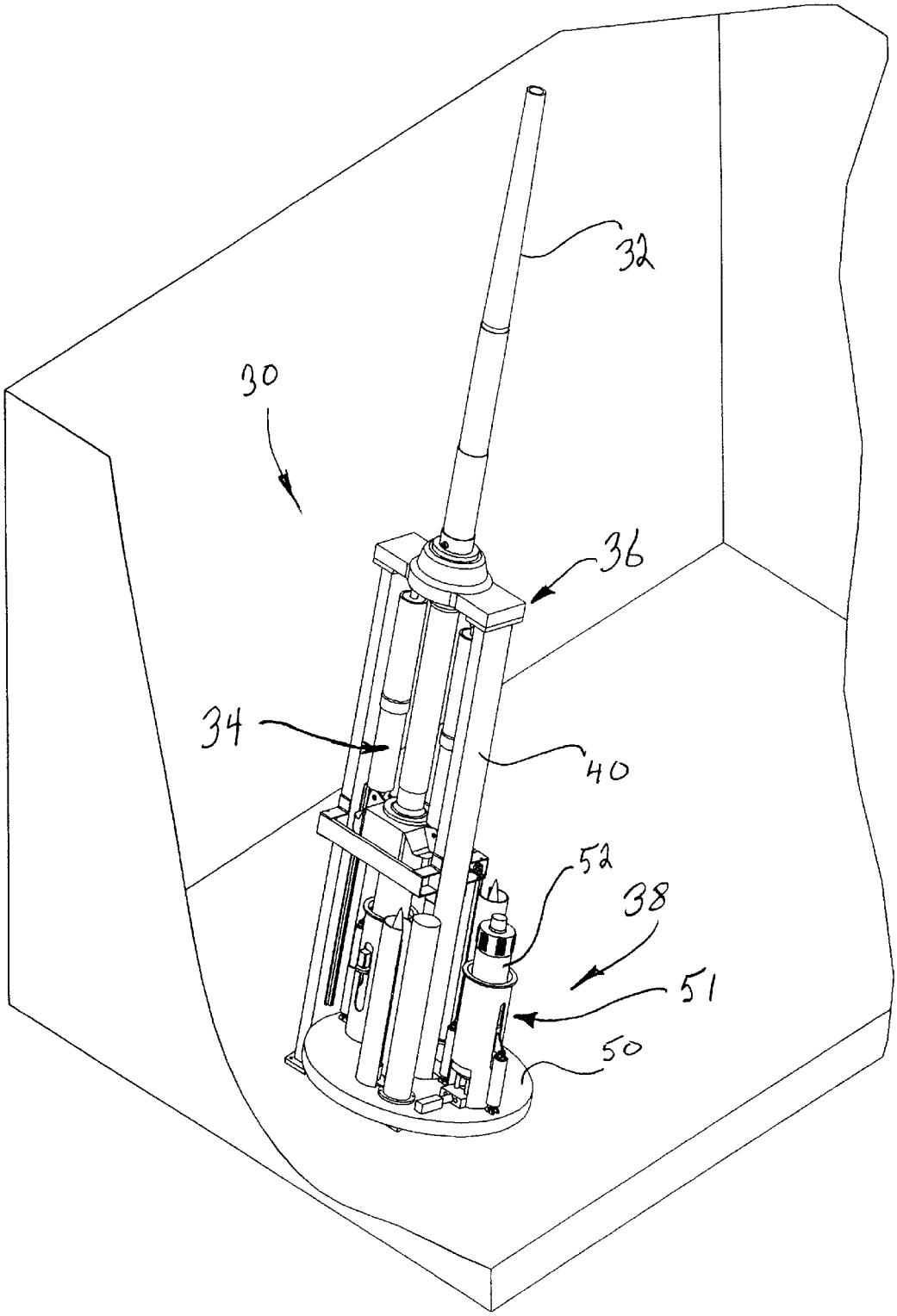
FIG. 1 is a perspective view of a gun assembly according to this invention.
Figure 2:
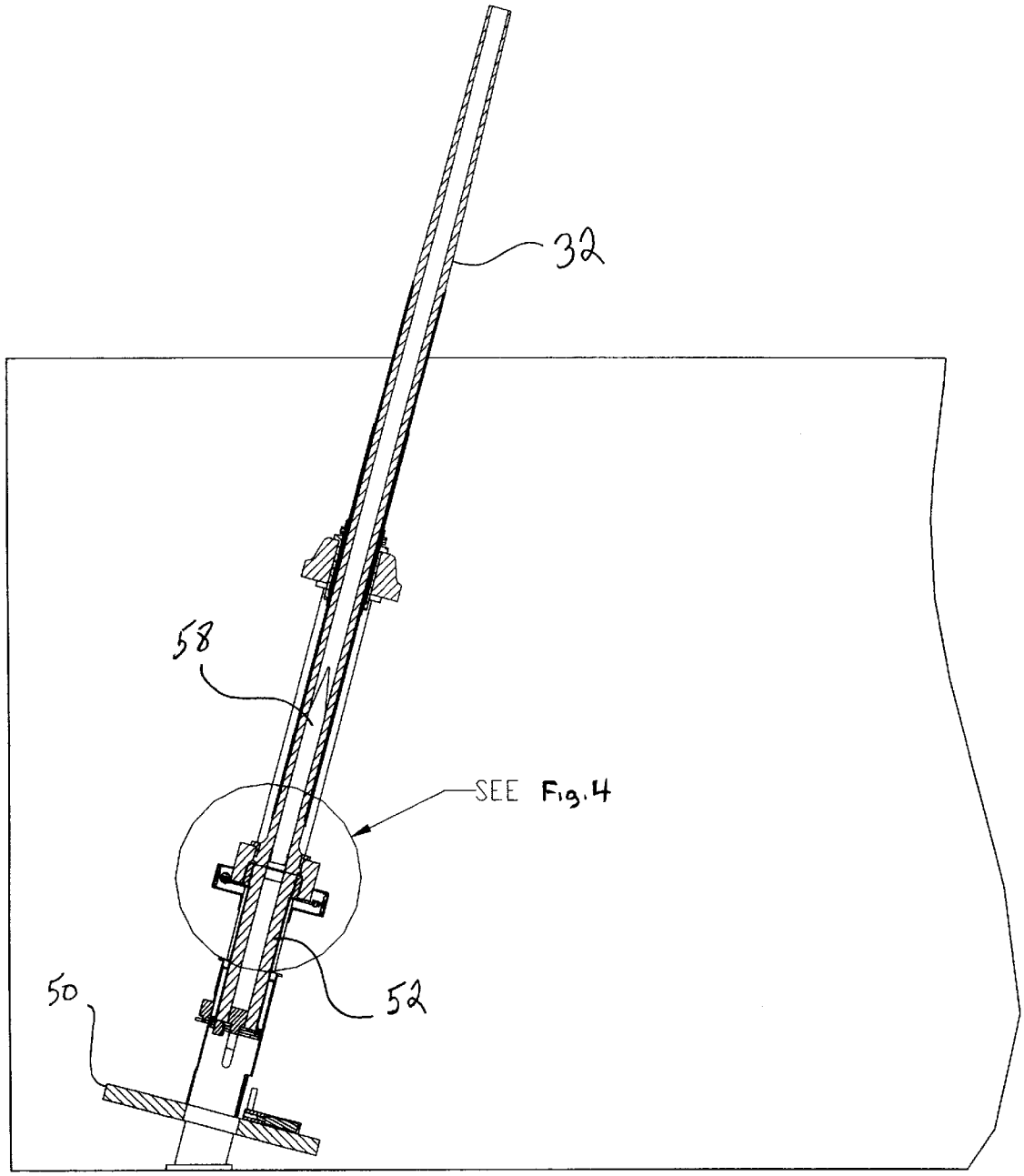
FIG. 2 is a sectional side elevation of the gun assembly shown in FIG. 1.
Figure 3:
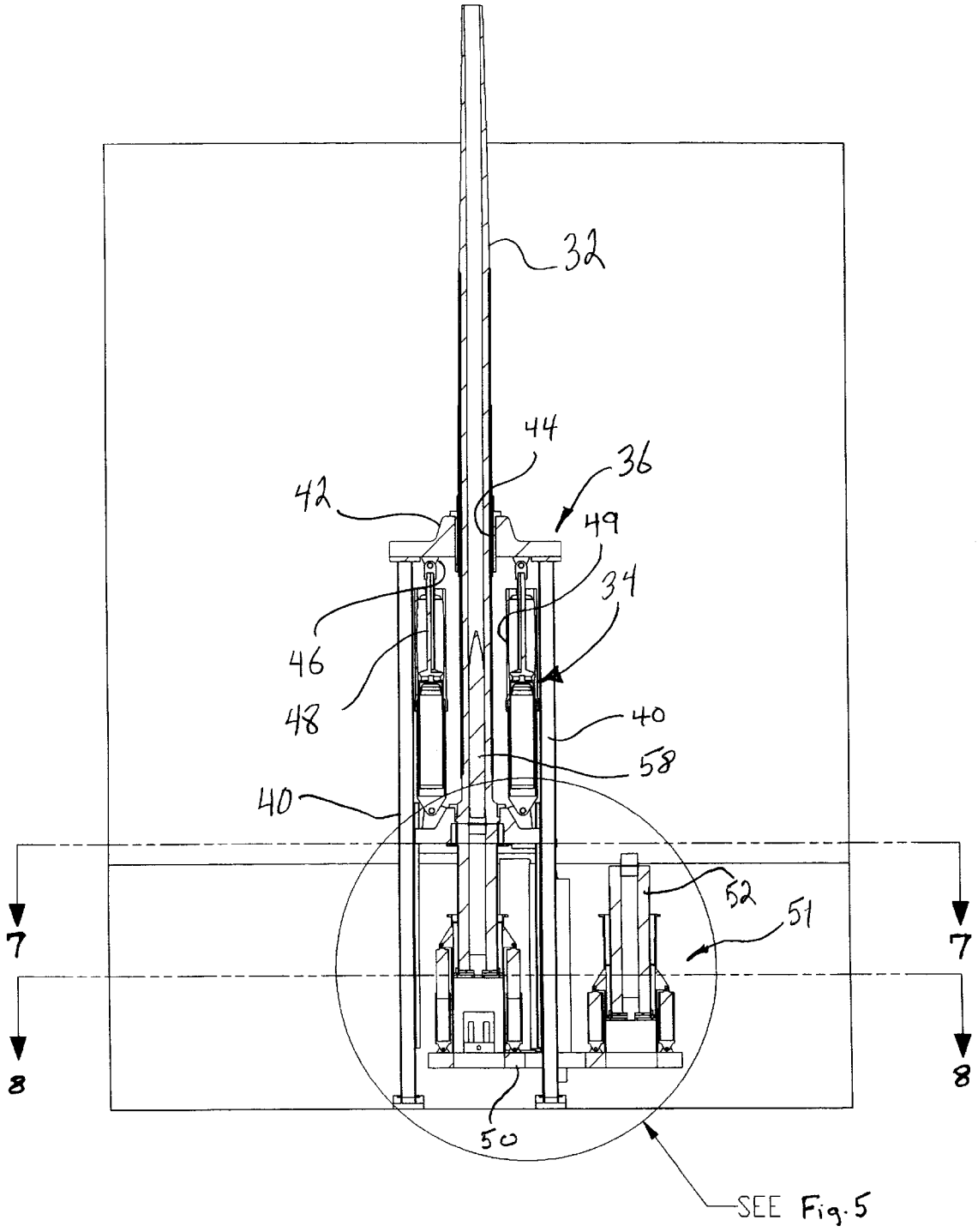
FIG. 3 is a sectional front elevation of the gun assembly shown in FIG. 1.

Turning now to the drawings, wherein like reference characters identify identical or corresponding parts, and more particularly to FIGS. 1–3 thereof, a long range artillery cannon 30 is shown having an elongated barrel 32 mounted in a recoil mechanism 34 attached to a main support structure 36 over a chamber shuttle turntable system 38.

The main support structure 36 includes two legs 40 and a cross head 42 attached to the front or upper end of the legs 40. The cross head 42 has a central axial opening 44 that receives and guides the barrel 32 during the axial movement of recoil and recovery to battery position. The underside of the cross head 42 has a pair of lugs 46 for connection to the upper ends of piston rods 48 operation in cylinders 49 of the recoil mechanism 34, as described in more detail below.

The chamber shuttle turntable system 38 has a turntable 50 that rotates around one of the support structure legs 40, providing two functions. It supports the mechanisms 51 that locate and elevate the two chambers 52 and it also supports the rammer/loader mechanisms 55 that ram projectiles 58 into the barrel. It rotates at the appropriate time of the firing cycle to align a chamber 52 or a loader/rammer 55 with the rear of the barrel.

Figure 4:
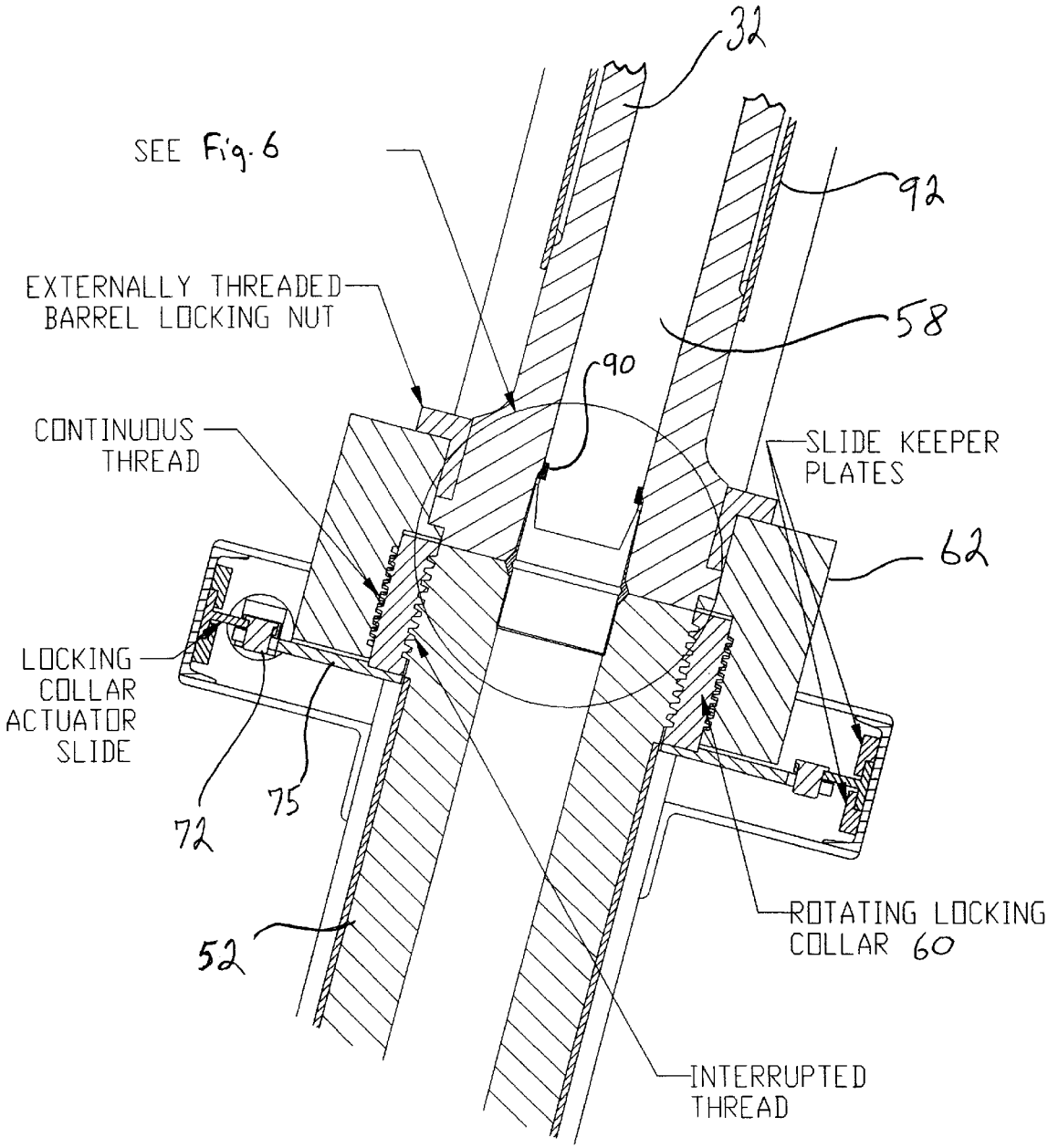
FIG. 4 is an enlarged sectional elevation of the circled area shown in FIG. 2.
Figure 5:
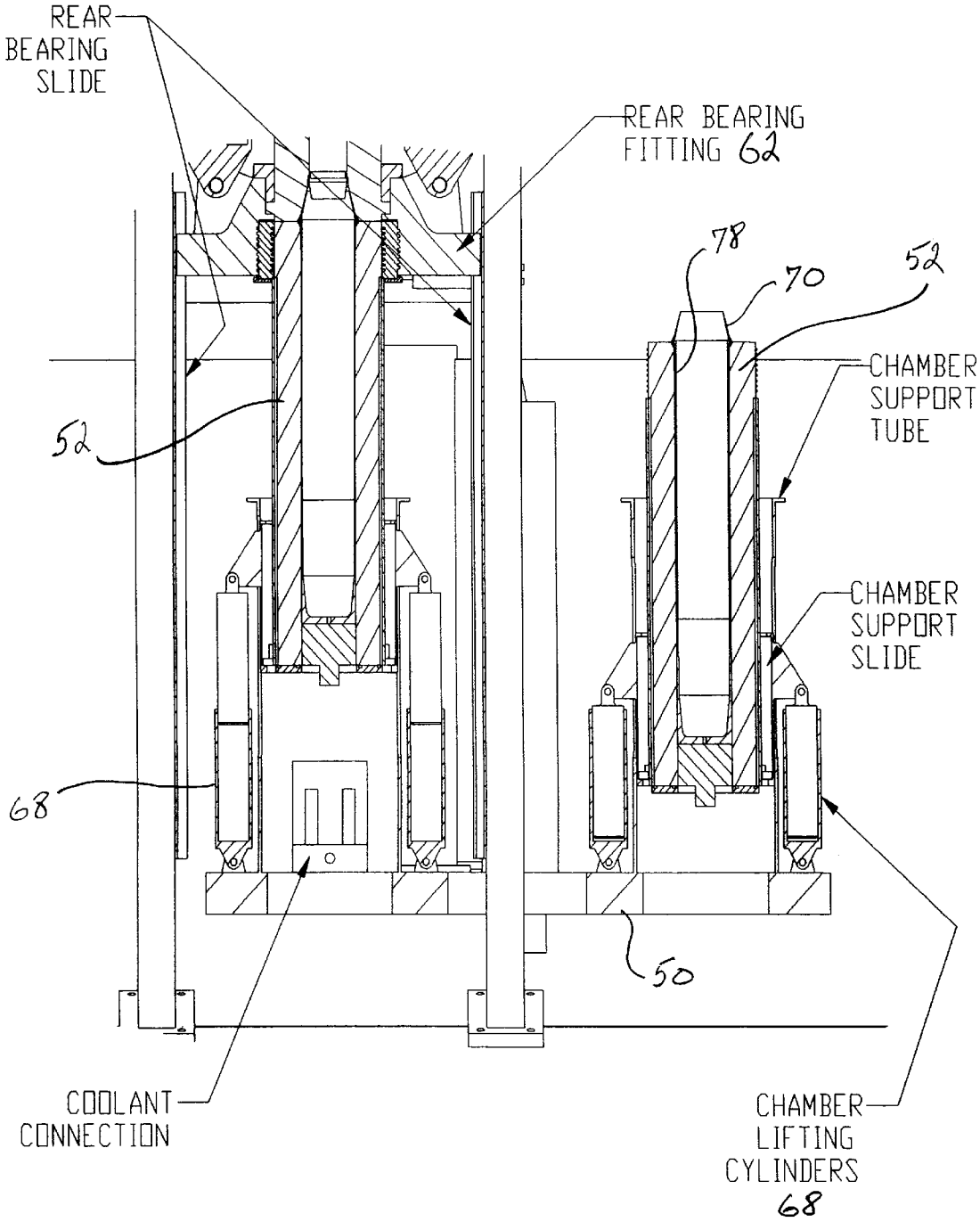
FIG. 5 is an enlarged sectional elevation of the circled area in FIG. 3.

The attachment of a chamber 52 to the barrel is by means of a rotating locking collar 60 that is screwed into a rear barrel fitting 62 and locates the end of the chamber 52 with either a six-part segmented bayonet connection or interrupted grooves. The preferred configuration is with the interrupted grooves (see FIG. 4) as it provides a more even load distribution along the length of the connection and is more compact. It is rotated through the 30° necessary to fully connect by means of hydraulic cylinders 65 acting tangentially (see FIG. 7). At the same time, axial force is maintained on the chamber by the lifting cylinders 68 (see FIG. 5) to ensure adequate seating of a high pressure seal 70 (see FIG. 6). The hydraulic cylinders 65 that rotate the locking collar 60 are mounted to the static support structure and apply force to the collar 60 by means of a sliding pin 72 engaging with a slot in a torque plate 75 which is attached to the collar 60 (see FIG. 4). During recoil, the pin 72 (which is non-recoiling) disengages from the slot in the torque plate 75 (which is recoiling) and then re-engages when the barrel returns to battery position. The chamber 52 is disengaged by reversing the above operations.

Sealing of Chamber Section to Barrel

Figure 6:
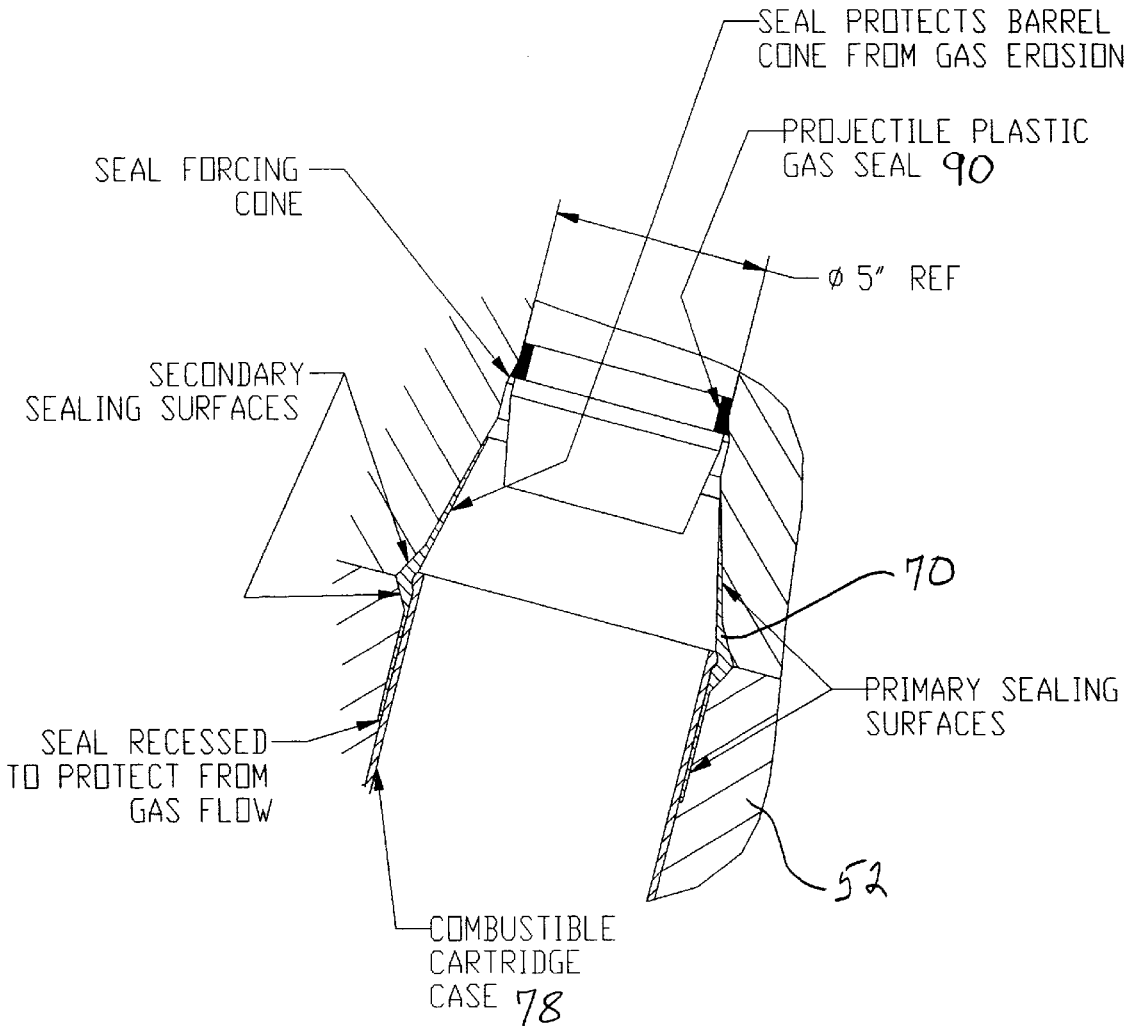
FIG. 6 is an enlarged sectional elevation of the circled area in FIG. 4.

The chamber 52 is designed to be loaded with a rigid combustible propellant charge case 78 incorporating the metallic high pressure sealing ring 70 clipped or molded into its down range end (see FIG. 6). This sealing ring is therefore replaced at each shot. The sealing function is performed in two ways. The primary method of sealing is via the stub cartridge case thin wall sleeve design at each end of the ring which expands under the effect of the rising gas pressure to contact the barrel/chamber wall during firing. The secondary (back-up) method is via the conical sections of the ring which are compressed during the barrel/chamber connection to produce a seal/tube interface pressure sufficient to seal the gas pressure prior to it rising and energizing the seal. The forward extension of the seal ring also protects the conical barrel surface where the chamber diameter transitions down to the bore diameter and where the potential for gas erosion is at the maximum.

The geometry of the seal 70, chamber 52 and barrel 32 are selected to ensure the seal 70 stays in the chamber when it is separated from the barrel. Prior to installing a new propelling charge, the old sealing ring 70 is removed and stored or discarded (the remainder of the propellant charge, including the case, having been fully consumed). The design of the sealing ring 70 facilitates easy removal after firing by means of a mechanical claw extractor being inserted into it and then expanded to lock in place. Incorporated with the extractor may be a compressed air supply to blow any dirt particles from the barrel/chamber sealing surfaces prior to insertion of the replacement charge.

Turntable

Figure 7:
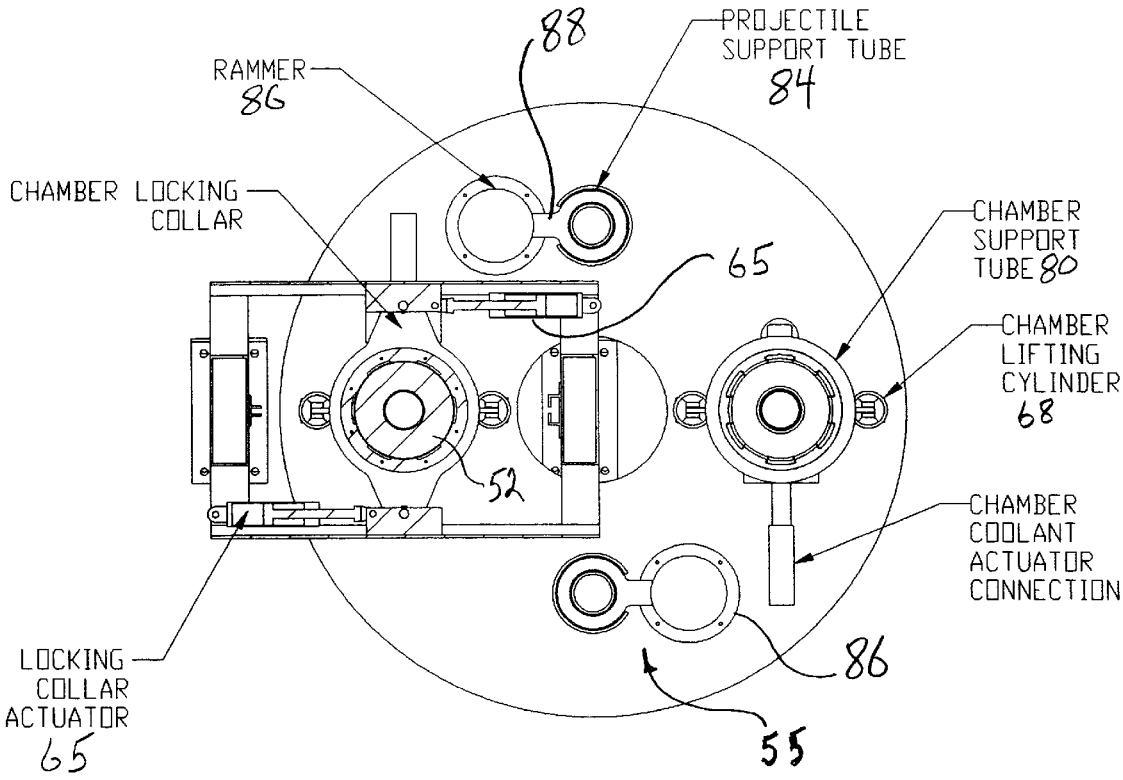
FIG. 7 is a sectional plan view along lines 7—7 in FIG. 3.
Figure 8:
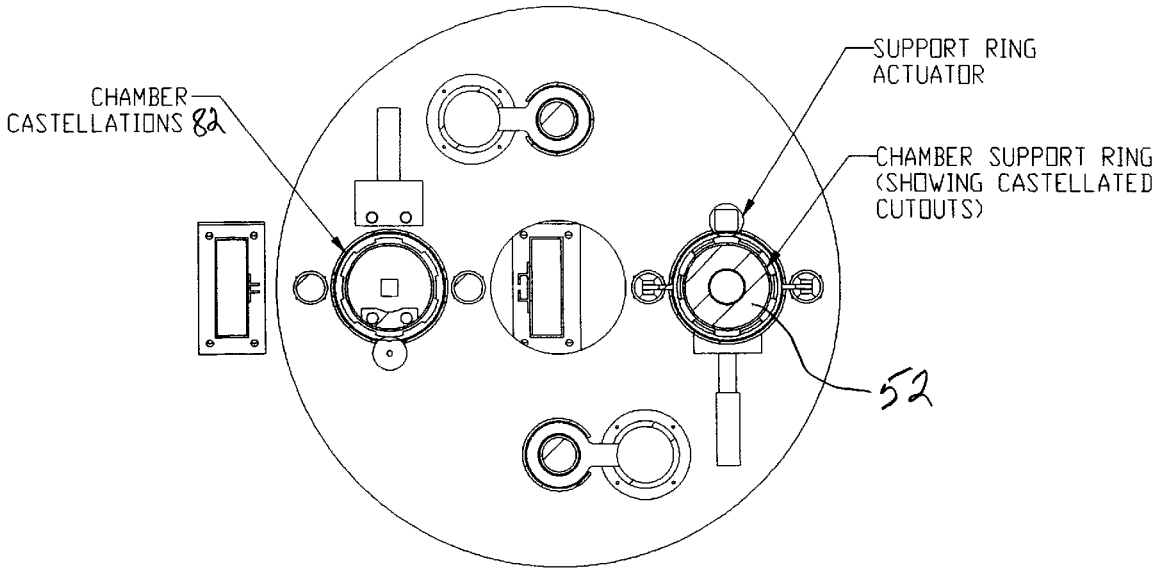
FIG. 8 is a sectional plan view along lines 8—8 in FIG. 3.

The turntable 50 is shown in FIGS. 7 & 8. The descriptions of the two types of mechanisms mounted to the turntable 50 are as follows:

Turntable chamber elevating/support—There are two alternatives for this attachment and these are as follows:

Alternative 1) A rotating locking collar in the rear barrel fitting-chamber does not rotate. The chamber 52 is located in the elevating/support mechanisms 51 in a non-rotating sliding sleeve 80 which supports it in between shots as well as guides it whilst being raised by hydraulic cylinders to mate with the rear face of the barrel. At the base of the chamber are castellated features 82. At the base of the sliding sleeve is a rotating support ring which has a castellated internal diameter and is hydraulically actuated. The chamber castellations rest on the ring castellations whilst the chamber is being raised into position or is in the rest position between shots. After the chamber is attached to the barrel by means of the locking collar, the support ring is rotated such that the castellations are now out of phase with each other, thereby allowing the chamber clearance to recoil through the ring.

Alternative 2) The chamber section is rotated. An alternative method of effecting the connection between the chamber and the barrel is to directly mate the chamber to the connection fitting, instead of via a locking ring, by means of bayonet features or interrupted threads. The joint is then tightened by rotating the chamber. The high pressure seal may be compressed by either the action of the chamber torque resulting in axial force via the interrupted threads or helical profile on the bayonet interface, or more directly, by the hydraulic cylinders which raise and lower the chamber. The disadvantage of this method is that the acceleration/deceleration forces involved in rotating a heavy object such as the chamber requires additional support structure, energy input and time. This may be objectionable for high firing rates.

Turntable projectile loader/rammer—Projectiles are introduced into a support tube 84 of the loader/rammer 55 by means of a handling system (not described herein). Parallel to and alongside the support tube is a hydraulic cylinder 86 that has an arm 88 extending under the projectile base. This causes the projectile to be rammed into the lower end of the barrel such that a seal 90 on the projectile 58 is compressed into the barrel forcing cone. This keeps the projectile 58 from falling back down into the support tube when the loader/rammer 55 is withdrawn.

Cooling

Figure 11:
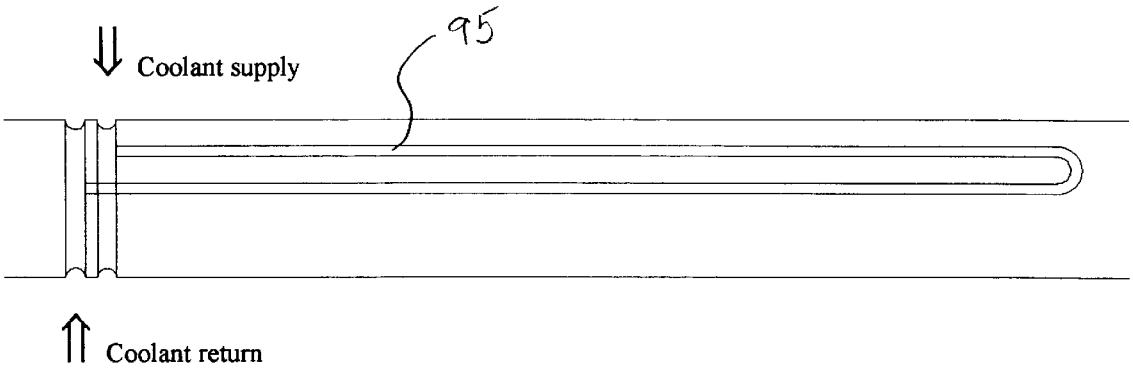
FIG. 11 is an elevation of the barrel shown in FIG. 1 with the barrel sleeve removed to show cooling channels.

The gun described herein has been designed with integrated active cooling. This is not a requirement of the overall design but does permit higher rates of fire by removing the heat from the areas where it is mainly generated, i.e., the barrel 32, the chamber 52, and recoil cylinders. The sketches show a thin wall sleeve 92 shrunk fitted around the barrel 32. The barrel has axial grooves 95 machined in its exterior (see FIG. 11). The assembly of the sleeve to the barrel creates passageways that contain the cooling fluid. The front barrel slide acts as the interface at which the cooling fluid is introduced and evacuated from the barrel.

Due to the fact that the chamber 52 is passed from one support medium to another, a continuous cooling fluid connection cannot be maintained to it. Hence coolant only flows when the chamber has been returned to its mount on the turntable and interfaces with the coolant connections (see FIGS. 5 and 7). The duration which coolant flows to the chamber is slightly less than two shots.

The recoil cylinders 49 can either be wrapped with cooling jackets or, in the case of the energy recovery configuration, the fluid can be cooled during its passage to the external accumulators as described below.

Recoil

The most efficient and most common method of absorbing recoil energy is via the throttling of hydraulic fluid. Traditional recoil cylinder configurations can be adapted to function satisfactorily. However, if a traditional recoil cylinder is used, a counterrecoil cylinder is also required to return the gun to the battery position.

Figure 9:
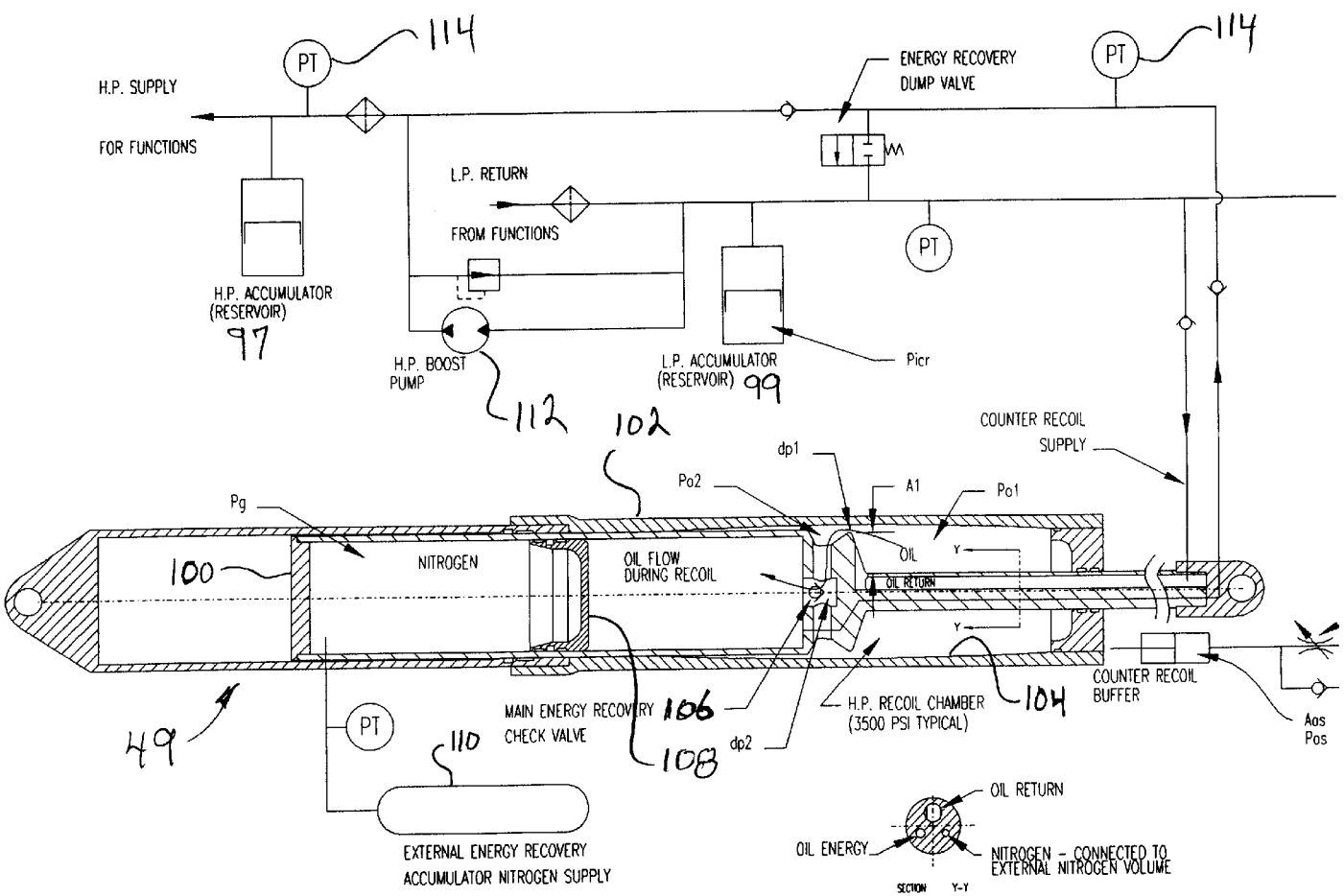
FIG. 9 is a sectional elevation of a recoil cylinder and an attached hydraulic schematic diagram of recoil energy recovery system.

The following configuration has a counterrecoil as well as a recoil function and also provides the ability to extract hydraulic fluid energy from the recoil stroke which can be used to supplement overall system energy requirements to power functions such as breech locking and ammunition loading mechanism actuation. Where it is used for energy recovery, the removal of fluid during each recoil cycle also facilitates cooling via a heat exchanger. The fluid which has been heated by absorbing recoil energy is replaced with cool fluid from an external low pressure accumulator for each shot (see explanation below and hydraulic schematic). The recoil cylinder design and the hydraulic schematic for energy recovery is shown in FIG. 9. Counterrecoil snubbing can be easily incorporated internally into this cylinder design.

Recoil energy recovery—The recoil cylinder 49 can be configured, together with an external high-pressure accumulator 97 and low pressure accumulator 99, to recover hydraulic energy. During recoil, the barrel's imparted energy is absorbed by the throttling of the hydraulic fluid through the varying orifice produced between the outside of a recoil piston 100 and the bore of the cylinder extension 102. The diameter of the bore 104 is varied along length thereof to ensure a constant and hence a minimum recoil force. This fluid is then forced through a check valve 106 where some energy is also absorbed by the compression of the nitrogen gas behind a floating piston 108 in the energy recovery accumulator inside the piston 100. This gas volume is supplemented by an exterior gas cylinder 110 to minimize the gas pressure increase when it is compressed by the displaced recoil fluid. After recoil, stored energy, in the form of the pressurized fluid is transferred from the energy recovery accumulator to the high-pressure external accumulator 97. Should this accumulator be fully charged, surplus fluid is dumped to the low pressure accumulator 99 via a bypass valve. The low-pressure external accumulator also provides the fluid pressure required to produce the retraction force in the cylinder to return the system to battery position. A high-pressure boost pump 112 is incorporated in the circuit to make up the difference between the hydraulic energy required for operation of all the systems and that which is supplied by the energy recovery. Pressure transducers 114 are placed appropriately in the system to ensure fail safe operation.

Figure 10:
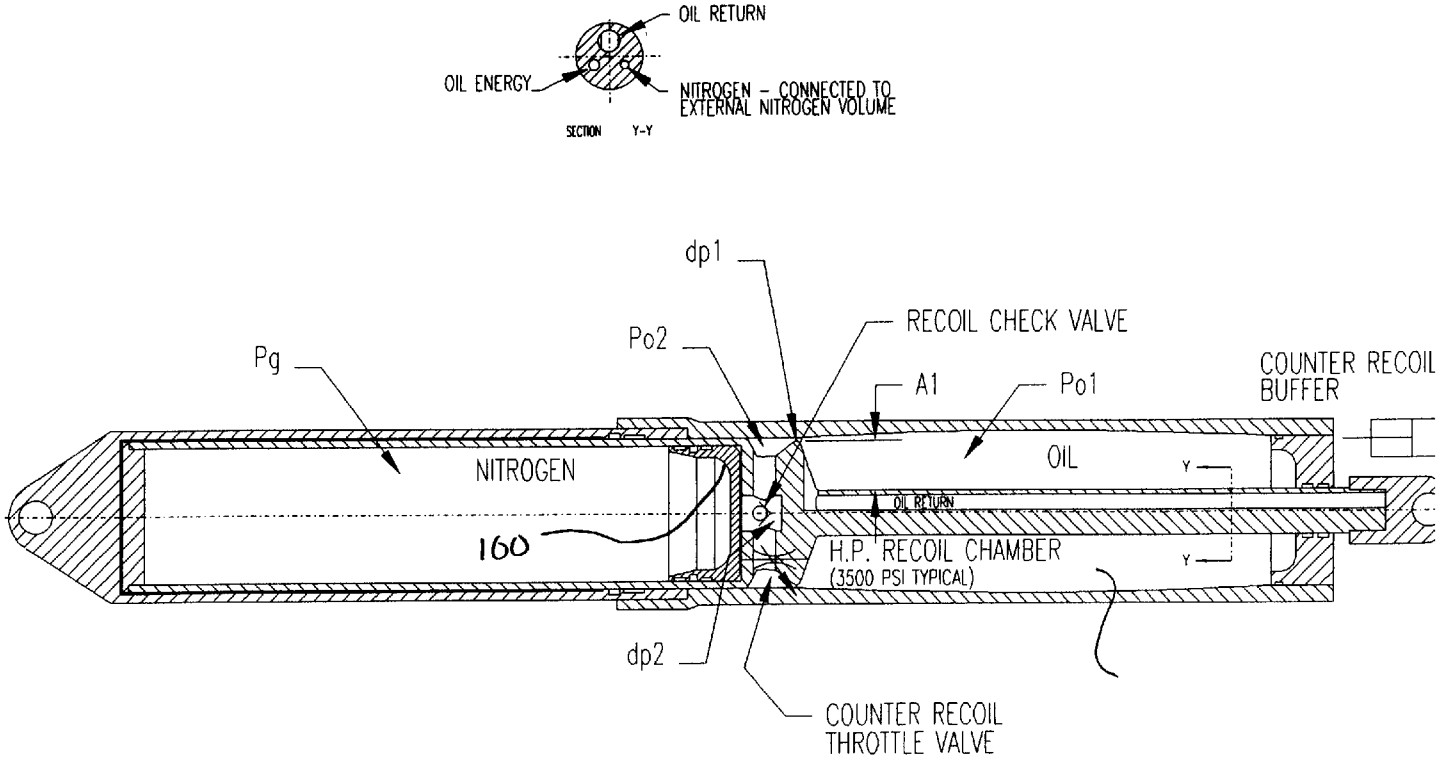
FIG. 10 is a sectional elevation of a recoil cylinder configured to provided a self contained counterrecoil force.

No energy recovery—Should energy recovery not be required, the recoil cylinder can also be simply configured to provided a self contained counterrecoil force using the integral floating piston 100 and compressed gas to retract the cylinder after recoiling—see FIG. 10. After recoiling as described above, the compressed fluid passes back to the recoil chamber past the check valve and piston via an orifice. This produces the retraction force in the cylinder required to return the system to battery position. Cooling can be provided by an external water jacket around the cylinder.

In both cases, the cylinder rod 48 is attached to the gun support structure 42 and the cylinder 49 is attached to the recoiling components. This facilitates connections from the recoil piston to the exterior components for the two oil lines and one gas line necessary per cylinder and also permits bleeding of the system at the highest point.

The design of the recoil cylinder incorporates common existing technology and can therefore be designed for reliability. Also, the attachments to the support structure provide for very simple and quick replacement.

Stowage

Weapon stowage may be simply compacted by retracting the barrel the full recoil distance. This is achieved by pumping fluid out of the recoil cylinder and into a separate storage volume. Further retraction is possible by either a longer recoil cylinder or detachment of the recoil cylinder at one end and a separate system to raise and lower the weapon. In this case the chamber is detached from the barrel in the normal manner and the carousel rotated to an intermediate position to allow for clearance of the rear barrel connection fitting when retracted.

Maintenance

The most common major maintenance item is replacement of the barrel after it has developed unacceptable wear. Replacement is a relatively simple process, involving the removal of the front bearing slide and unscrewing the threaded retaining ring at the breech end. The tube can then be withdrawn through the hole in the front support structure.

Features, Advantages and Benefits

| Features | Advantages | Benefits |
|---|---|---|
| 1.0 The cannon is separated between the chamber and projectile seat. | 1.1 The length of barrel becomes shorter for a given cannon assembly length. | 1.1.1 Manufacturing - This assists the manufacturing process in a number of ways. During manufacture, the difficulty is increased as the length of component increases. This applies to the forging, heat treatment, exterior machining, interior boring and autofrettage processes. A shorter barrel would reduce manufacturing costs by permitting simpler manufacturing techniques. |
| | | 1.1.2 Transportation - A shorter barrel permits transportation of all components in a shorter container, allowing deployment by smaller vehicles/vessels. |
| | | 1.1.3 Stowage - The barrel may be retracted during stowage down to the level of the chamber interface, thereby reducing radar signature. Alternatively, with the chamber moved aside, the barrel may be |

-continued

| Features | Advantages | Benefits |
|---|---|---|
| | | retracted down to the level of the base of the gun mount area, further reducing radar signature. |
| | 1.2 Easy access to the forcing cone area. | 1.2.1 Cleaning - Easier cleaning, and inspection of the seal area during operation. |
| | | 1.2.2 Cooling - Forced-air cooling is possible of both the chamber and forcing cone areas. |
| | 1.3 A separate chamber and barrel permits many variations of each to be fitted to the same mount. | 1.3.1 Flexibility - This enables many different projectile/propellant combinations to be fired. |
| | | 1.3.2 Optimum material selection - The material used in the manufacture of a separate barrel and chamber can be different and specifically selected to suit their particular operational requirements. |
| | 1.4 A separate barrel allows for easy replacement during service. | 1.4.1 Wear specific components - The barrel is the primary part of a gun that suffers from wear. The majority of the other components are not replaced until their fatigue lives are reached. |
| | | 1.4.2 Time saving - Simplifying replacement reduces time out of commission. |
| 2.0 The chamber and projectile loader/rammer are duplicated and positioned on a turntable such that each of the chambers and each of the loader/rammers align with the barrel when the turntable is indexed. | 2.1 This allows simultaneous loading of propellant in one chamber while the other is being attached to the gun for firing. This also applies to the two rammer/loader stations that are positioned in between the two chamber mounts. | 2.1.1 Compressed time budget - The gun can be fired at a higher rate as it permits parallel functioning. Ie., The used metallic gas seal can be removed and the next round of propellant can be loaded into one chamber while the other is being attached to the rear of the barrel. Also, the next projectile can be positioned in the loader/rammer at the same time as the other is rammed, etc. |
| | | 2.2.2 Fault bypass - Should a fault occur in any one of the two projectile rammer/loaders or chamber stations, the gun can continue firing (albeit at a lower rate) using the remaining functioning station. |
| | | 2.2.3 Facilitate cooling - The chamber has additional time to cool in between shots. |
| 3.0 The connection between the chamber and barrel is protected by a short metallic sleeve/seal. This is attached to the rigid combustible cartridge case and is hence replaced with each shot. | 3.1 Protects transition area between chamber and forcing cone from effects of propellant gas | 3.1.1 Increased barrel life. |
| | | 3.2.1 Reduced handling requirements when removing after shot. |
| | 3.2 Smaller than cartridge case | 3.3.1 More compact - A large diameter chamber is beneficial as it reduces the chamber length for a given volume, thereby reducing the overall length of the gun. This in turn reduces the amount of barrel protrusion above deck. |
| | 3.3 Permits a larger ratio of chamber diameter to projectile diameter (the erosion effects in the transition area from propellant gas become more destructive as the ratio increases). | 3.3.2 Safer ignition - Simplifies obtaining efficient and safe propellant ignition. As the ratio of L/D increases, so does the difficulty in ensuring even ignition of the propellant. |
| 4.0 Accessible recoil cylinders | 4.1 Easily replaceable | 4.1.1 Time saving - Out of commission time reduced. |
| | | 4.1.2 Performance matching - Different recoil characteristics may be incorporated for different barrel/chamber combinations. |

Method of Operation

The configuration of the gun with the turntable mounted chambers and loader/rammers permits some operations to be done in parallel. This facilitates a faster firing rate. The following table clarifies the operations during one complete firing cycle, starting from the recoil stroke.

| OP # | FIRING CYCLE TIME BUDGET (GUN) | OPERATIONS DONE IN PARALLEL |
|---|---|---|
| 1 | RECOIL | |
| 2 | COUNTERRECOIL | |
| 3 | ROTATE CHAMBER SUPPORT RING TO SUPPORT POSITION | |
| 4 | UNLOAD CHAMBER #1 LOCK RING | |
| 5 | UNLOCK CHAMBER #1 FROM BARREL | |
| 6 | LOWER CHAMBER #1 | |
| 7 | ROTATE CAROUSEL TO PROJECTILE LOAD POSITION | CONNECT COOLING TO CHAMBER #1 |
| 8 | RAM PROJECTILE INTO BARREL | REMOVE CHAMBER #1 SEAL & CLEAN |
| 9 | RETRACT RAMMER | DISCONNECT COOLING TO CHAMBER #2 |
| 10 | ROTATE CAROUSEL TO PROPELLANT LOAD POSITION | |
| 11 | RAISE CHAMBER #2 TO BARREL | REPLENISH CHAMBER #1 & PROJECTILE TUBE |
| 12 | LOCK CHAMBER #2 TO BARREL | |
| 13 | UNLOAD CHAMBER #2 SUPPORT RING | |
| 14 | ROTATE SUPPORT RING TO RECOIL POSITION | |
| 15 | FIRE | |

Obviously, numerous modifications and variations of the preferred embodiment described above are possible and will become apparent to those skilled in the art in light of this specification. Moreover, many functions and advantages are described for the preferred embodiment, but in many uses of the invention, not all of these functions and advantages would be needed. Therefore, we contemplate the use of the invention using fewer than the complete set of noted features, process steps, benefits, functions and advantages. Moreover, several species and embodiments of the invention are disclosed herein, but not all are specifically claimed, although all are covered by generic claims. Nevertheless, it is our intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, in all their combinations, are to be considered within the spirit and scope of the invention as defined in the following claims, wherein

We claim:

1. A gun assembly, comprising:

a gun barrel and a separable chamber;

said separable chamber includes a plug at one end that accommodates a propellant ignition system;

said separable chamber having an open end opposite said one end, said open end having interrupted threads or bayonet fittings for connection to said barrel by way of rotating locking collar;

a connection fitting having a continuous internal thread for threadedly engaging continuous external threads on said locking collar;

said locking collar has internal bayonet features or interrupted thread to engage said interrupted threads or bayonet fittings at said open end of said chamber;

a torque plate attached to a lower face of said collar and extending radially beyond said connection fitting;

a slot in said torque plate aligned with a pin of a slide actuator attached to a frame cross-member;

whereby said actuator pin is located inside the torque plate slot when said gun assembly is in a battery position and is disengaged from said slot during recoil to disengage said chamber from said barrel during recoil.

2. A gun assembly as defined in claim 1, further comprising:

a projectile propellant canister for use in said gun assembly having a consumable casing and a high pressure gas seal at an outer end thereof for providing a gas seal at the interface between said open end of said chamber and said gun barrel;

whereby high pressure gases created by propellant combustion are sealed with said high-pressure gas compression seal at said interface between said chamber and said barrel.

3. A gun assembly as defined in claim 1, further comprising:

said connection fitting has an attachment for a rear cannon bearing slide which rides on rails attached to a main support structure;

whereby any torque induced into said barrel from the actuation of said chamber/barrel is reacted into said locking collar.

4. A gun assembly as defined in claim 1, further comprising:

recoil cylinders mounted in front of said chamber/barrel connection fitting;

said recoil cylinders having pistons with piston rods attached to said connection fitting;

said recoil cylinders having front ends connected to a main gun support to support the front of said recoil cylinders and transmit recoil forces generated when said gun fires to said main support;

whereby an extended "wheelbase" between the front and rear slides ensures improved shot repeatability.

5. A gun assembly as defined in claim 1, further comprising:

a turntable upon which are mounted two chamber elevating/support mechanisms and two projectile loader/rammer mechanisms is positioned around one of said main support structure legs.

* * * * *

UNITED STATES PATENT AND TRADEMARK OFFICE

CERTIFICATE OF CORRECTION

PATENT NO. : 6,571,676 B1
APPLICATION NO. : 10/006319
DATED : June 3, 2003
INVENTOR(S) : Lawrence R. Folsom et al.

It is certified that error appears in the above-identified patent and that said Letters Patent is hereby corrected as shown below:

IN THE SPECIFICATION -

In Column 1, please add the following paragraph as Paragraph 1 after the title:

-- The U.S. Government has a paid-up license in this invention and the right in limited circumstances to require the patent owner to llcense others on reasonable terms as provided for by the terms of N00178-04-D-1025 awarded by Naval Surface Warfare Center Dahlgren Division. --

Signed and Sealed this

Tenth Day of April, 2007

JON W. DUDAS
*Director of the United States Patent and Trademark Office*